US011759037B2

(12) United States Patent
Rahmany et al.

(10) Patent No.: US 11,759,037 B2
(45) Date of Patent: Sep. 19, 2023

(54) DRINKING STRAW

(71) Applicant: QATAR UNIVERSITY, Doha (QA)

(72) Inventors: Abdulrahman Abdulaziz Rahmany, Al Wakra (QA); Abir Esia Karami, Al Wakra (QA)

(73) Assignee: QATAR UNIVERSITY, Doha (QA)

( * ) Notice: Subject to any disclaimer, the term of this patent is extended or adjusted under 35 U.S.C. 154(b) by 265 days.

(21) Appl. No.: 16/733,622

(22) Filed: Jan. 3, 2020

(65) Prior Publication Data

US 2020/0214486 A1 Jul. 9, 2020

Related U.S. Application Data

(60) Provisional application No. 62/788,919, filed on Jan. 6, 2019, provisional application No. 62/788,945, filed on Jan. 6, 2019, provisional application No. 62/894,028, filed on Aug. 30, 2019.

(51) Int. Cl.
*A47G 21/18* (2006.01)

(52) U.S. Cl.
CPC ..... *A47G 21/18* (2013.01)

(58) Field of Classification Search
CPC ..... A47G 21/18; A47G 21/183; A47G 2400/027; B67D 1/0456; B67D 7/0277; B65D 47/248; B65D 2517/0046; A62B 18/086
See application file for complete search history.

(56) References Cited

U.S. PATENT DOCUMENTS

| | | | | |
|---|---|---|---|---|
| 4,034,780 | A * | 7/1977 | Horvath | F16K 15/03 137/527.8 |
| 4,971,048 | A * | 11/1990 | Seekins | A47G 21/18 128/200.24 |
| 9,386,870 | B2 | 7/2016 | Rossitto | |
| 2007/0262164 | A1 | 11/2007 | Gelfand | |
| 2008/0075809 | A1 | 3/2008 | Anderson | |
| 2008/0116292 | A1 | 5/2008 | Nesbitt et al. | |
| 2010/0276509 | A1 | 11/2010 | Mauro | |
| 2012/0012597 | A1 * | 1/2012 | Rossitto | A47G 21/18 220/705 |
| 2019/0000719 | A1 | 1/2019 | Nollmal | |

FOREIGN PATENT DOCUMENTS

CN 202653800 U 1/2013

OTHER PUBLICATIONS

"Ark's One-Way Straws", Copyright 2019 ARK Therapeutic, https://www.arktherapeutic.com/arks-one-way-straws/.

* cited by examiner

*Primary Examiner* — Tuongminh N Pham
(74) *Attorney, Agent, or Firm* — SQUIRE PATTON BOGGS (US) LLP

(57) ABSTRACT

A drinking straw may include an outer layer defining an exterior of the drinking straw and an internal space of the drinking straw. The drinking straw may also include an upper end and a lower end. Each of the upper end and the lower end may define a respective opening. The drinking straw may further include a movable cover disposed within the internal space at the lower end covering the opening at the lower end.

8 Claims, 10 Drawing Sheets

DRINKING STRAW

CROSS REFERENCE TO RELATED APPLICATION

This application claims priority to U.S. Provisional Application Nos. 62/788,919 and 62/788,945 filed on Jan. 6, 2019, and U.S. Provisional Application No. 62/894,028 filed on Aug. 30, 2019. The entire contents of the above-referenced provisional applications are hereby incorporated by reference.

FIELD OF INVENTION

Certain embodiments may generally relate to a drinking straw. More specifically, certain embodiments may generally relate to a drinking straw with one or more parts to decrease an amount of air formed inside the drinking straw.

BACKGROUND OF THE INVENTION

A conventional drinking straw (hereinafter, "straw") may generally be identified as an object having an elongated tube or pipe with an opening on both ends. The openings allow a user of the straw to consume a beverage by placing one end of the straw into the beverage, and the opposite end of the straw in the mouth. The conventional straw may be made of various types of materials including, for example, paper, bamboo stainless steel, plastic, or other materials. The straw may also have various shapes and configurations including, for example, a permanent straight configuration, or have an angle-adjustable segment. In addition, the straw may be a single-use straw or multi-use straw.

To use the straw, the user places his or her mouth on one end of the straw while the opposite end is placed in a liquid. Once the user's mouth is properly positioned, a combination of muscular action of the tongue and cheeks reduces air pressure in the mouth and above the liquid in the straw, whereupon atmospheric pressure forces the liquid through the straw and into the user's mouth.

Although generally simple in design and use, the conventional drinking straw comes with several drawbacks. One drawback is a problem with air forming inside the straw within an empty space between the liquid and the upper end of the straw. Users swallow this air many times until the liquid is finished, which lowers the quality of the user experience and creates a perception of feeling uncomfortable due to the consumption of air.

When the user stops drinking from the straw, an amount of the liquid that is inside the straw moves down back to the liquid container (e.g., glass), and air forms inside the straw again. The user repeats the process of swallowing the air until the liquid is mostly or entirely consumed. Drinking using conventional straws causes air to enter the user's stomach, which results in the user feeling uncomfortable, and causes the user exhibit gassy, bloated, and/or belch symptoms. Accordingly, there is a need for an improved drinking straw that addresses the problem of air forming inside the straw in the empty space between the liquid and the upper end of the straw, and to minimize the amount of air consumed by the user when using the straw.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

SUMMARY OF THE INVENTION

One embodiment may be directed to a drinking straw. The drinking straw may include an outer layer defining an exterior of the drinking straw and an internal space of the drinking straw. The drinking straw may also include an upper end and a lower end. In an embodiment, each of the upper end and the lower end may define a respective opening. Further, the drinking straw may include a movable cover disposed within the internal space at the lower end covering the opening at the lower end covering the opening at the lower end.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical or structural changes may be made to the invention without departing from the spirit or scope of this disclosure. To avoid detail not necessary to enable those skilled in the art to practice the embodiments described herein, the description may omit certain information known to those skilled in the art. The following detailed description is, therefore, not to be taken in a limiting sense.

DETAILED DESCRIPTION

The features, structures, or characteristics of the invention described throughout this specification may be combined in any suitable manner in one or more embodiments. For example, the usage of the phrases "certain embodiments," "some embodiments," or other similar language, throughout this specification refers to the fact that a particular feature, structure, or characteristic described in connection with the embodiment may be included in at least one embodiment of the present invention. Further, "drinking straw" and "straw" may be used interchangeably throughout this disclosure.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical or structural changes may be made to the invention without departing from the spirit or scope of this disclosure. To avoid detail not necessary to enable those skilled in the art to practice the embodiments described herein, the description may omit certain information known to those skilled in the art. In addition, the examples described herein are for illustrative purposes only. The following detailed description is, therefore, not to be taken in a limiting sense.

Figure 1:
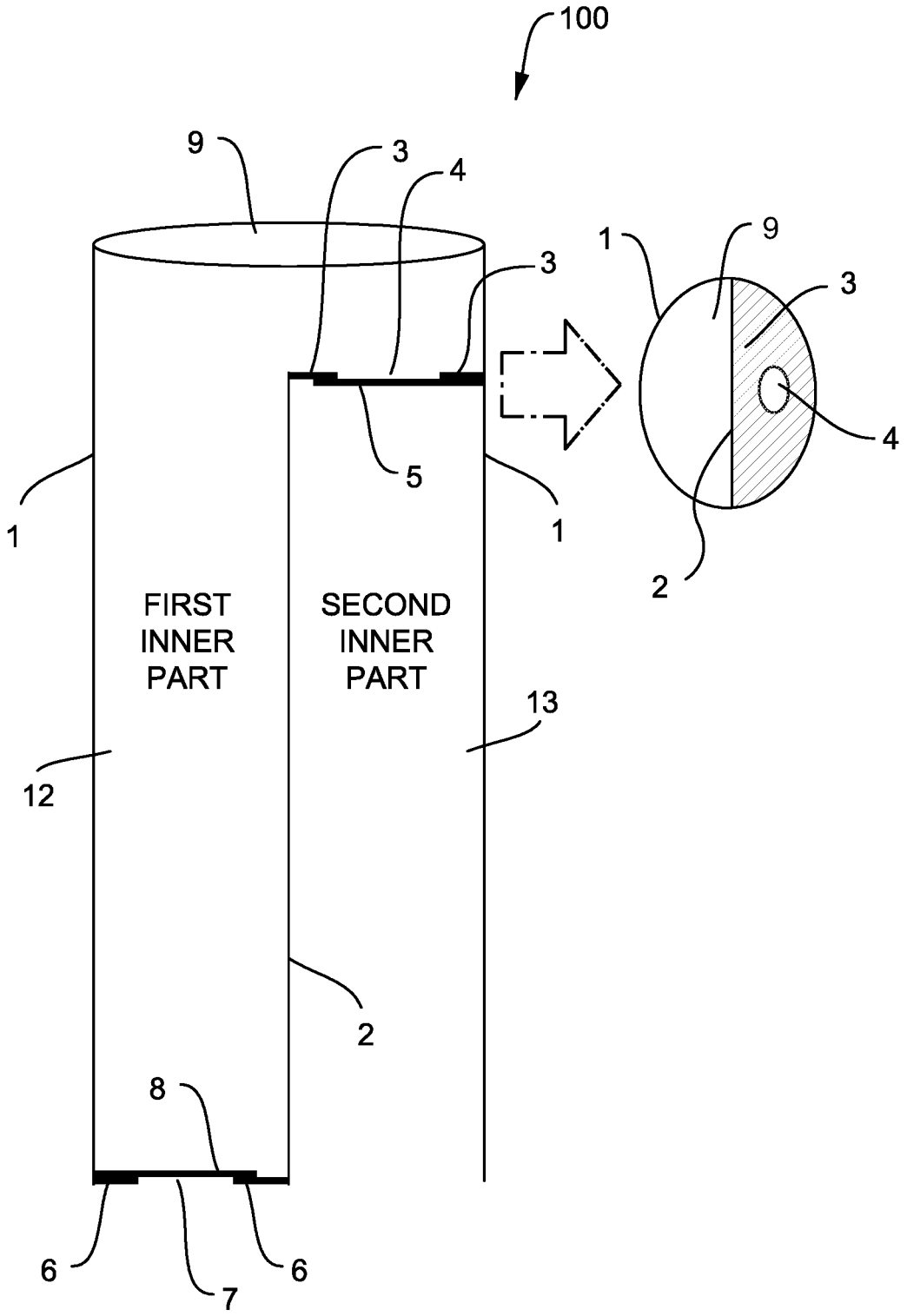
FIG. 1 illustrates elements of a drinking straw according to an embodiment.

FIG. 1 illustrates elements of a drinking straw 100 according to an embodiment. The drinking straw 100 may include an outer layer 1. According to an embodiment, the outer layer 1 may form a tube that may be in various shapes including, for example, circular, square, rectangular, and other shapes of pipes. In another embodiment, the outer layer 1 may be wrapped around the entire exterior of the drinking straw 100, and define an empty space within the drinking straw 100.

As further illustrated in FIG. 1, the drinking straw 100 may include an inner wall 2. According to an embodiment, the inner wall 2 may be located inside an interior space of the drinking straw 100. For example, as illustrated in FIG. 1, the inner wall 2 may separate the drinking straw 100 into two inner compartments, a first inner compartment 12 and a second inner compartment 13. FIG. 1 also illustrates that in one embodiment, the drinking straw 100 may include a second pair of edge piece 3 that closes an upper part of the inner wall 2, and extends over the second inner compartment 13.

In an embodiment, the second pair of edge piece 3 may define a second hole 4 of the second inner compartment 13, and the drinking straw 100 may include a second cover 5, which may be a piece attached from one of its sides to the lower part of the second pair of edge piece 3. According to another embodiment, the second cover 5 may be attached to the outer layer 1 as well, and act as a gate covering the second hole 4 from the lower side. In another embodiment, the second cover 5 may be configured to move down from its unattached side(s) to open the second hole 4, or closed by sticking the second cover 5 to the second pair of edge piece 3. In an embodiment, the drinking straw 100 may also include a first pair of edge piece 6 that closes the lower part of the inner wall to a part of the outer layer 1. As illustrated in FIG. 1, the first pair of edge piece 6 may define a first hole 7, and the first hole 7 may be covered with a first cover 8. In an embodiment, the first cover 8 may be attached to the outer layer 1 from one of its sides or it may be attached to one of the edge pieces 6, and may be configured to move upward from its unattached sides to open the first hole 7, and close the first hole 7 by sticking the first cover 8 to the first pair of edge piece 6. In an embodiment, edge piece 3 connects the inner wall 2 to the outer layer 1 from the upper side of the drinking side 100, and edge piece 6 connects the inner wall 2 to the outer layer 1 from the lower side of the drinking straw 100.

Figure 2:
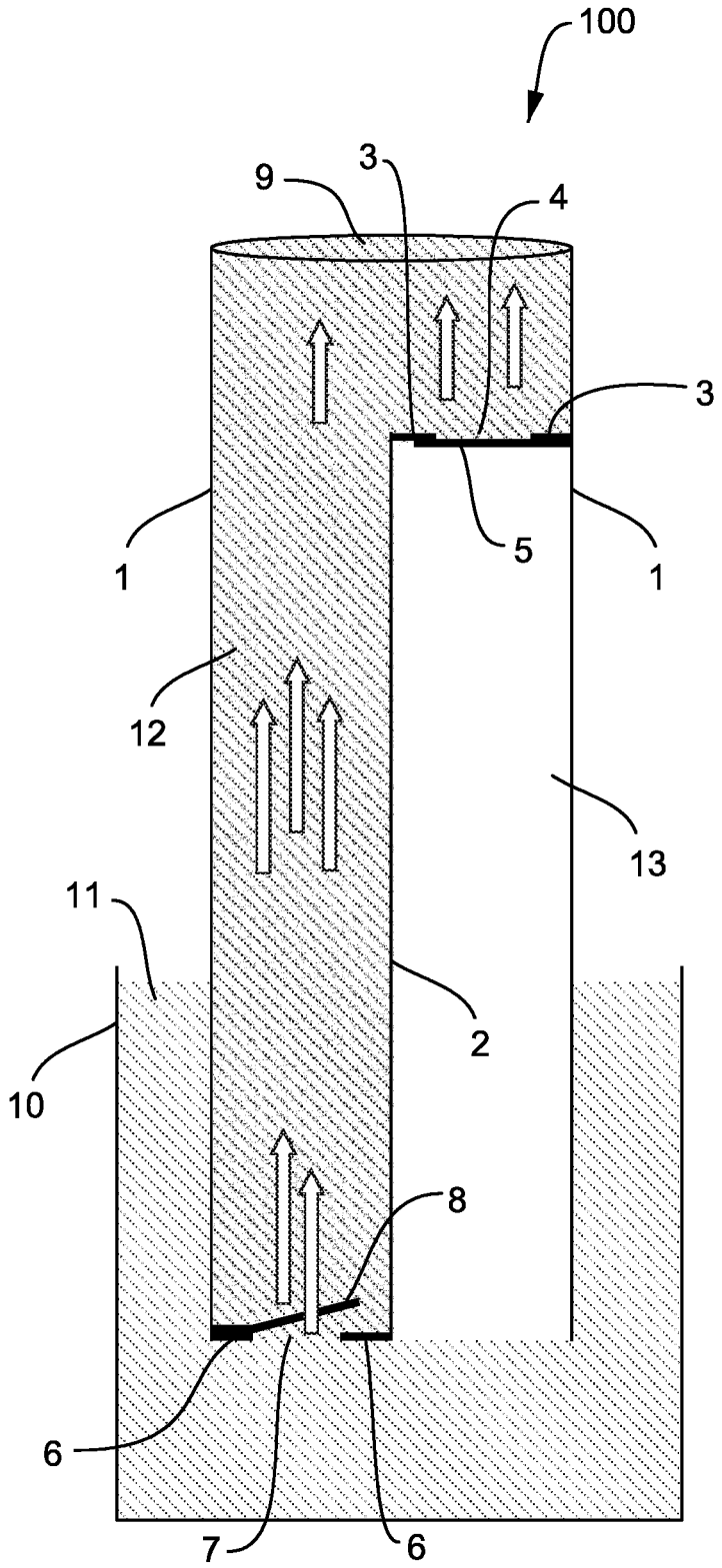
FIG. 2 illustrates how liquid passes from a container to the drinking straw according to an embodiment.

At the top of the drinking straw 100, is an upper end 9. In an embodiment, the upper end 9 may serve as a portion of the drinking straw 100 where a user may position his/her mouth and start drinking. Further, as illustrated in FIG. 2 discussed in more detail herein, the drinking straw 100 may be inserted into a container 10, such as a beverage container. In certain embodiments, the container 10 may be a wide range of containers including, for example, a cup, glass, or any type of drink/liquid container. The container 10 may also include a drink or liquid 11 such as, for example, coffee, tea, soft drinks, juice, water, etc. According to an embodiment, the drinking straw 100 may be made into various shapes such as, for example, a simple or flexible drinking straw, and may be made of various materials including, for example, plastic, paper, metal, or a combination of materials.

In certain embodiments, the first inner compartment 12 may be responsible for passing the liquid from the container 10 to the mouth of the user, and then keeping an amount of the liquid inside the drinking straw 100 when the user stops drinking the liquid. Further, the second inner part 13 may be responsible for drainage of the upper end 9 of the drinking straw 100 from the liquid to help keep the liquid that is maintained inside the drinking straw 100 from spilling out of the drinking straw 100 when moving the drinking straw 100 inside the container 10. By keeping an amount of liquid inside the drinking straw 100, the empty space that is inside the drinking straw 100 may be decreased so that the user would not have to swallow a large amount of air that is formed inside the drinking straw 100 every time he/she drinks using the drinking straw 100.

As illustrated in FIG. 1, the drinking straw 100 may include an upper end 9 that may include a hole, a second hole 4, and a first hole 7. In an embodiment, the hole of the upper end 9 and the first hole 7 may allow liquid to pass from the container 10 to the mouth of the user when the user inhales while using the drinking straw 100 (see FIG. 2).

FIG. 2 illustrates how liquid passes from the container 10 to the drinking straw 100 according to an embodiment. As illustrated in FIG. 2, with the force applied by the user at the upper end 9 of the drinking straw 100, the first cover 8 may open slightly upwards. In the meantime, the liquid may enter the first inner compartment 12 via the first hole 7, and flow upwards towards the upper end 9, and to the mouth of the user. When the user stops inhaling from the upper end 9 of the drinking straw 100, an amount of the liquid may remain inside the drinking straw 100, while the liquid that is near the upper end 9 of the straw moves back to the container 10.

Figure 3:
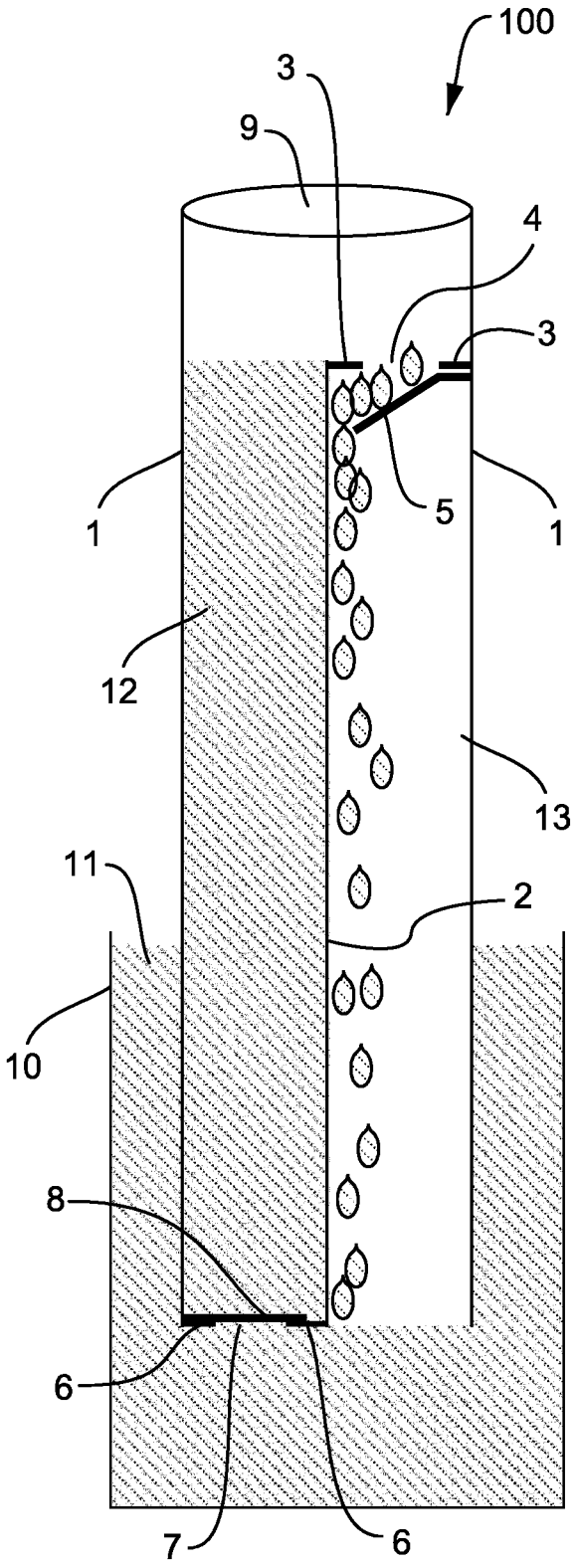
FIG. 3 illustrates how an amount of liquid moves from the drinking straw back to the container according to an embodiment.

FIG. 3 illustrates how an amount of liquid moves from the drinking straw 100 back to the container 10 according to an embodiment. For example, FIG. 3 illustrates how an amount of liquid at the upper end 9 of the drinking straw 100 travels back to the container 10. For example, when the user stops inhaling from the upper end 9 of the drinking straw 100, the first cover 8 closes the first hole 7 by returning the first cover 8 onto the first pair of edge piece 6. The weight of the liquid that is above the first cover 8 and the weight of the first cover 8 helps apply enough force to move the first cover 8 towards the first pair of edge piece 6, thereby closing the first hole 7. In the meantime, the liquid that is inside the drinking straw 100 remains at the top of the pieces 6, 8, 3, 4, and 5, up to the upper end 9 of the drinking straw 100. As illustrated in FIG. 3, as the liquid remains above the first pair of edge piece 3, the second hole 4, and the second cover 5, the liquid can move back to the container 10 by applying pressure on the second cover 5, which may force the second cover 5 to move slightly downward and provide a way or passage for the liquid to move through the second hole 4 back to the container 10 via the second inner compartment 13. After the liquid near the upper end 9 of the drinking straw 100 completely drains back into the container 10, the second cover 5 moves back toward the second pair of edge piece 3, thereby closing the second hole 4.

According to an embodiment, by moving the liquid from the upper end 9 of the drinking straw 100 back to the container 10, it may be possible to reduce the chances of pouring the liquid out of the drinking straw 100 if the drinking straw 100 is moved. Otherwise, the liquid may stop at the upper end 9 and pour out of the drinking straw 100 if the drinking straw 100 is moved. According to a further embodiment, by keeping an amount of the liquid inside the drinking straw 100, it may be possible to reduce the amount of air (empty space) inside the drinking straw 100. When there is less air inside the drinking straw 100, less air would be swallowed by the user when using the drinking straw 100.

In an embodiment, the pressure of the air in the empty part of the drinking straw 100 (e.g., an area under the second cover 5 and the second pair of edge piece 3) may push the drinking straw 100 out of the liquid that is inside the container 10. Thus, by having an amount of liquid inside the drinking straw 100 (e.g., in the area above the first pair of edge piece 6 and the first cover 8), the drinking straw may become heavier, which may help maintain the drinking straw 100 inside the container 10. Further, in an embodiment, by pushing down on the drinking straw 100 into the liquid that is in the container 10 before starting to drink, the second cover 5 may be pushed up slightly (by the liquid that is in the container 10), and allow the liquid to enter the drinking straw before the user beings to use the straw from the upper end 9.

Figure 4:
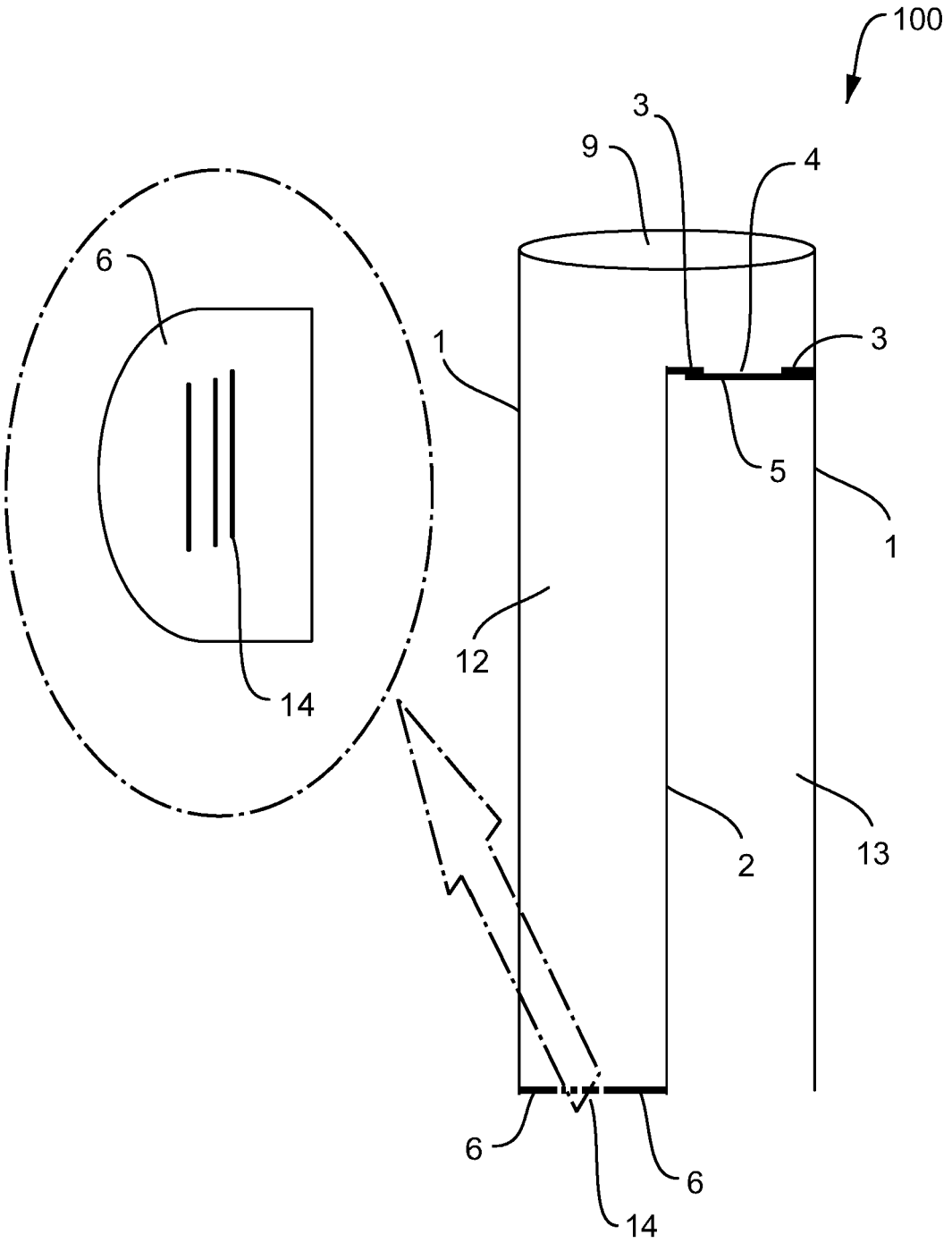
FIG. 4 illustrates a drinking straw with one or more cracks instead of one or more holes according to an embodiment.

FIG. 4 illustrates a drinking straw with one or more cracks instead of one or more holes according to an embodiment. The elements illustrated in FIG. 4 correspond to those of FIGS. 1-3 except for crack(s) 14, which replaced the first hole 7. As illustrated in FIG. 4, the edge piece 6 may include the crack(s) 14. For instance, the edge piece 6 may extend from the outer layer 1 all the way to the inner wall 2. Further, the crack(s) 14 may be included in the edge piece 6, and the edge piece 6 may be a single piece. In this embodiment, the liquid may not easily move in or out of the crack(s) 14 since the edge piece 6 tightens the crack(s) 14. When the user inhales through the drinking straw 100, the liquid may be forced from the container 10 into and through the crack(s) 14, thereby entering the first inner compartment 12 of the drinking straw 100 to pass the liquid to the user's mouth. When the user stops inhaling through the drinking straw 100, the edge piece 6 surrounding the crack(s) 14 may return to it's first/original shape (e.g., the crack(s) 14 may become tightened back to their initial shape) in order to prevent leakage of the liquid in or out of the first inner compartment 12. In an embodiment, this may help maintain the liquid inside the first inner compartment 12 to prevent air from forming inside the drinking straw 100 by filling part of the drinking straw 100 with the liquid. According to an embodiment, the drainage of the upper part of the drinking straw 100 may be completed the same way as of the embodiment illustrated in FIG. 3.

Figure 5:
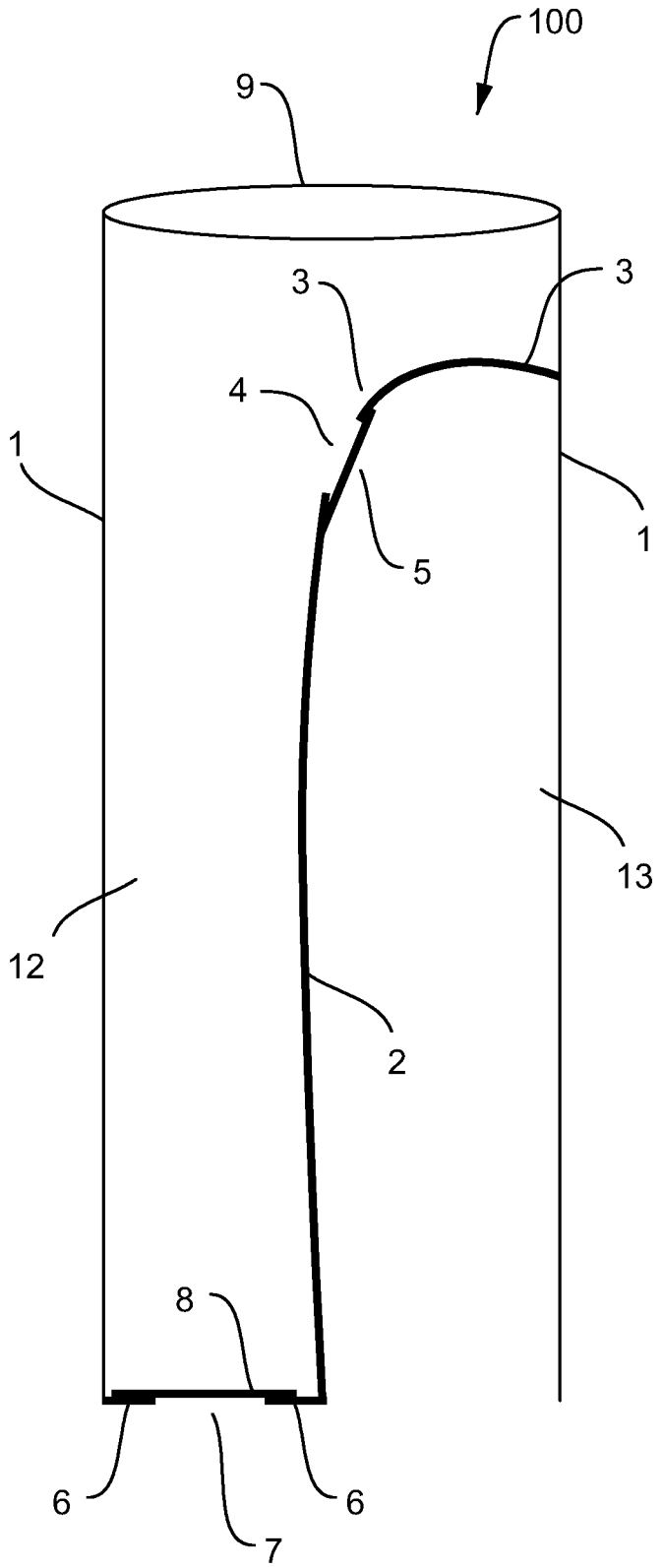
FIG. 5 illustrates a drinking straw according to another embodiment.
Figure 6:
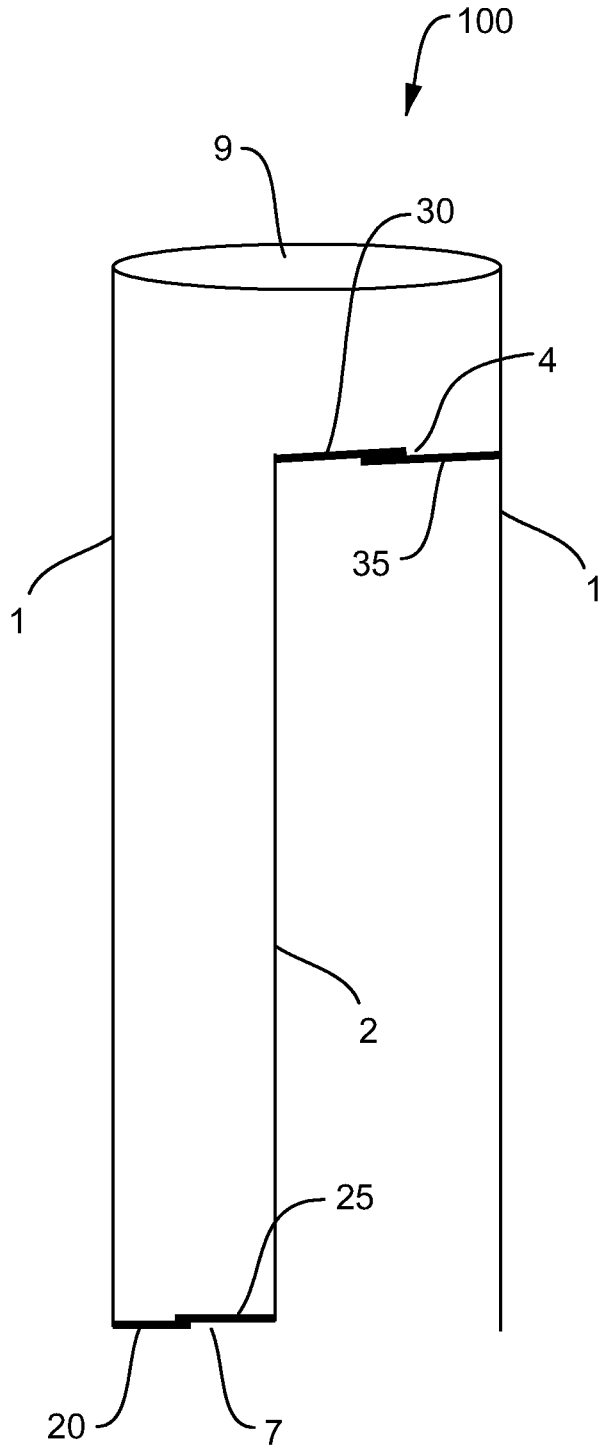
FIG. 6 illustrates a further drinking straw according to an embodiment.

FIG. 5 illustrates a drinking straw according to another embodiment with a different structural design as compared to that illustrated in FIGS. 1-4. As illustrated in FIG. 5, the internal elements described above with respect to FIGS. 1-4 may be designed in various ways to have the same or similar functionality. However, according to an embodiment, as illustrated in FIG. 5, the second cover 5 may be located at an edge or side of the inner wall 2. Further, FIG. 6 illustrates a drinking straw according to another embodiment with a different structural design as compared to that illustrated in FIGS. 1-5, and FIG. 7 illustrates how an amount of liquid passes from the container 10 to the drinking straw 100 of FIG. 6 according to an embodiment. In addition, FIG. 8 illustrates how an amount of liquid moves from the drinking straw of FIG. 6 back to the container 10 according to an embodiment.

Figure 7:
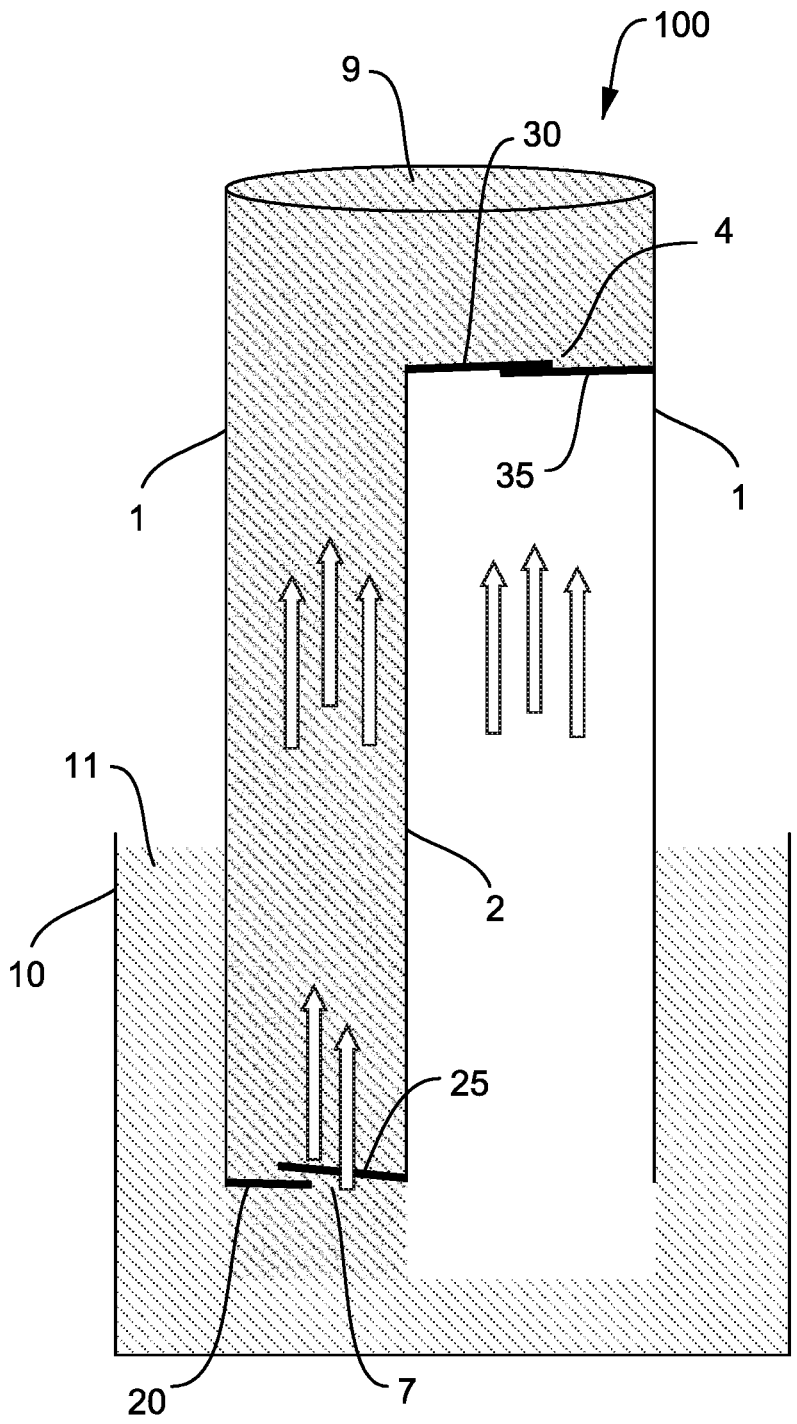
FIG. 7 illustrates how an amount of liquid passes from the container to the drinking straw of FIG. 6 according to an embodiment.
Figure 8:
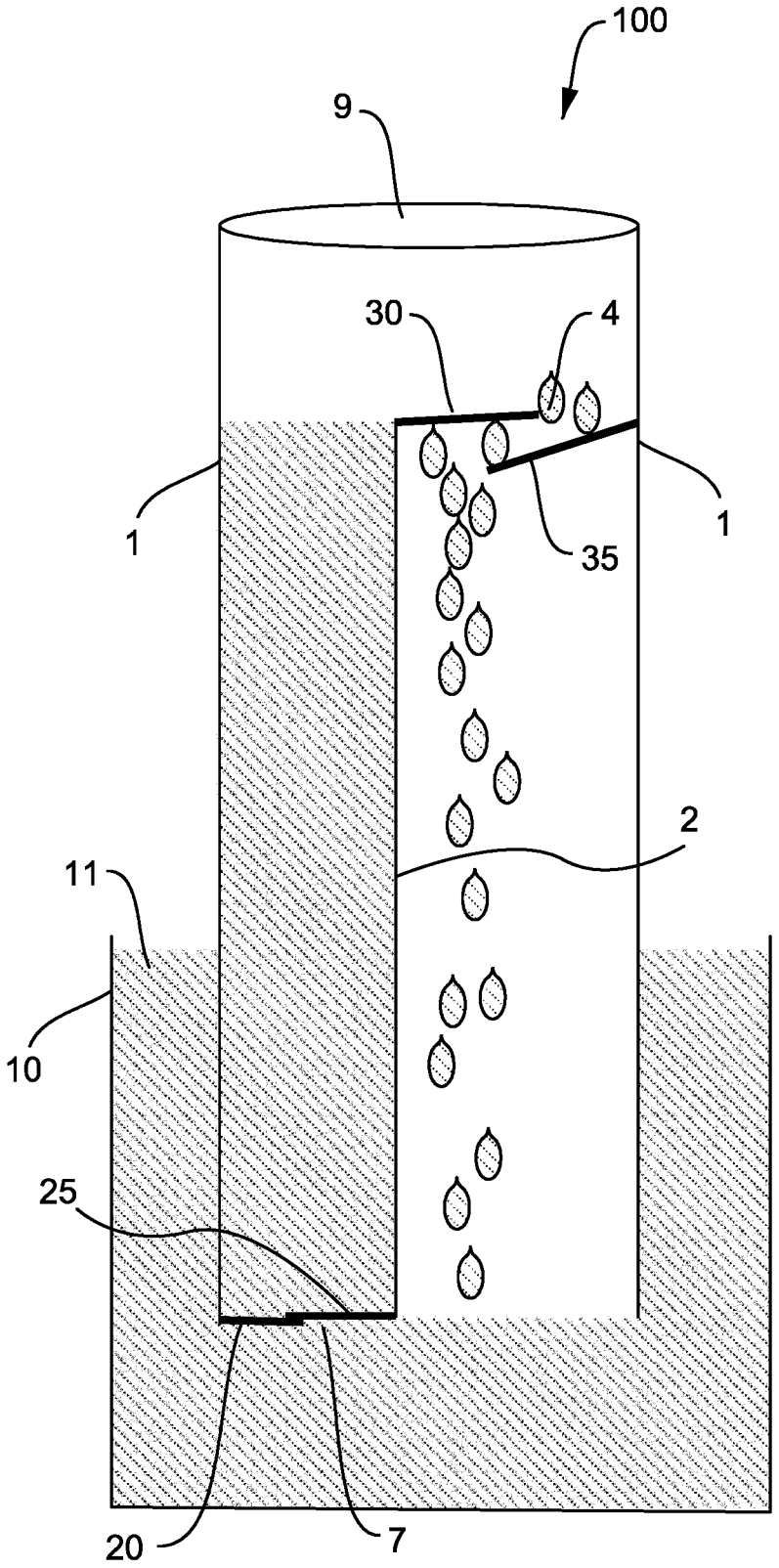
FIG. 8 illustrates how an amount of liquid moves from the drinking straw of FIG. 6 back to the container according to an embodiment.

As illustrated in FIGS. 6-8, instead of holes, two aligned pieces may be used. For example, in one embodiment, a first piece 20 may be aligned with a second piece 25, and a third piece 30 may be aligned with a fourth piece 35. As illustrated in FIGS. 6-8, a portion of the first piece 20 may overlap with a portion of the second piece 25, and a portion of the third piece 30 may overlap with a portion of the fourth piece 35. When these pieces are aligned on each other, they may stop the liquid from passing in or out of the drinking straw 100. Further, when the user inhales from the upper end 9 of the drinking straw 100, the first piece 25 may move slightly upward to allow the liquid to pass into the drinking straw 100 through the first hole 7 to the user's mouth. As illustrated in FIGS. 6-8, the first hole 7 may be an open area between the first piece 20 and the second piece 25. When the user stops inhaling through the drinking straw 100, the liquid that is aligned or above the third piece 30 and the fourth piece 35 may put pressure on the third piece 30 and the fourth piece 35 forcing one or both of these pieces to slightly open to allow the liquid to pass through the second hole 4 between the third piece 30 and the fourth piece 35 (see FIG. 8).

In an embodiment, the first piece 20 and the second piece 25 may cover hole 7 of the first inner compartment 12. According to another embodiment, the first piece 20 may be attached to the outer layer 1 within the first inner compartment 12, and the second piece 25 may be attached to inner wall 2 within the first inner compartment 12. In a further embodiment, the third piece 30 and the fourth piece 35 may cover the second hole 4. In addition, according to one embodiment, the third piece 30 may be attached to the inner wall 2, and the fourth piece 35 may be attached to the outer layer 1 within the second inner compartment 13. In another embodiment, the first piece 20 may be attached to the outer layer 1, and the second piece 25 may be attached to the inner wall 2.

Figure 9:
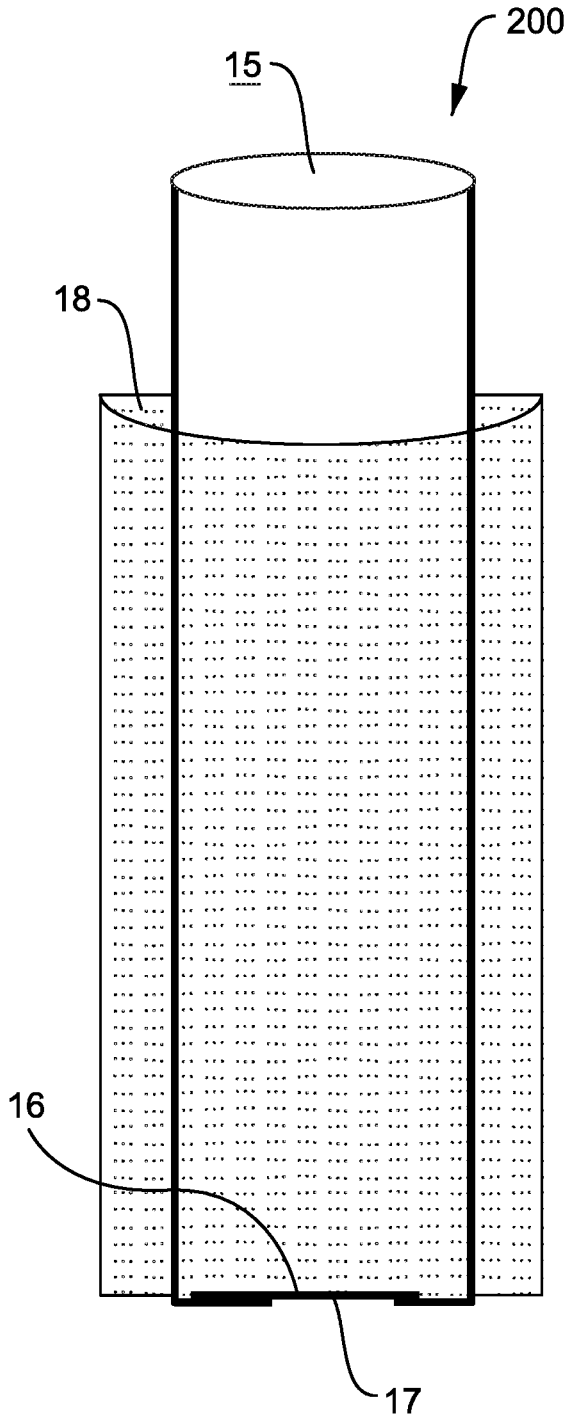
FIG. 9 illustrates a drinking straw according to another embodiment.
Figure 10:
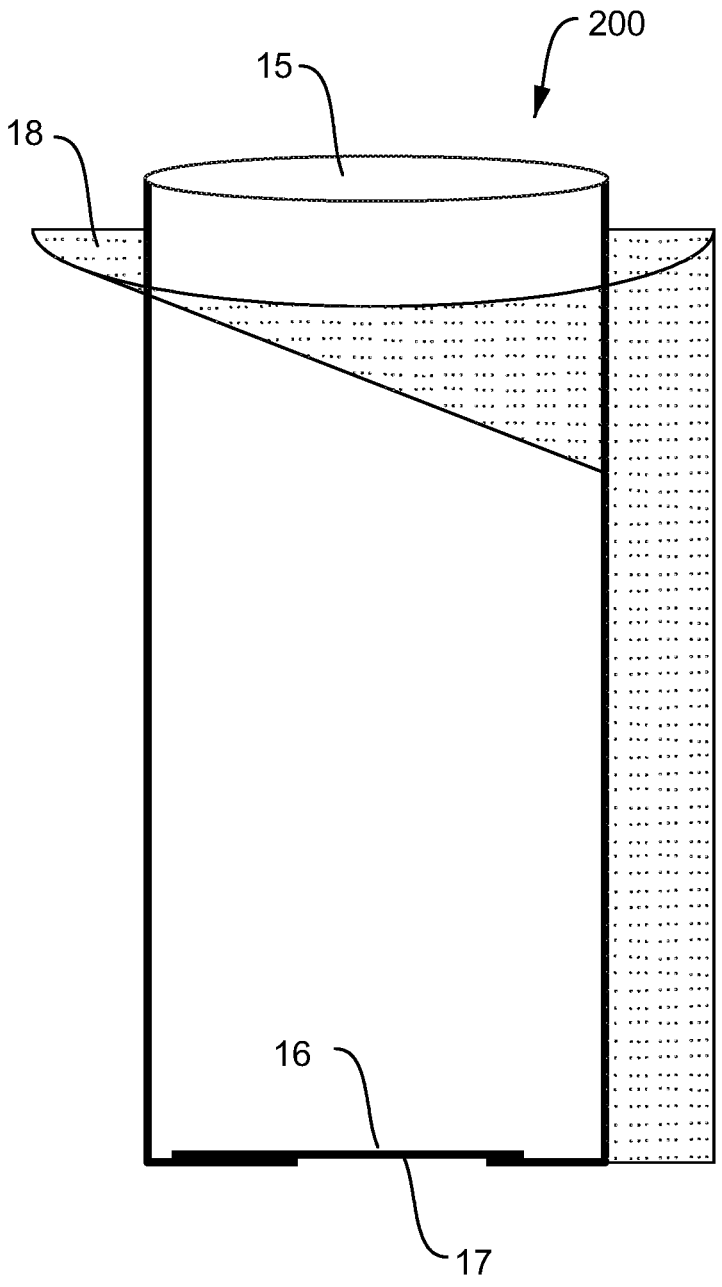
FIG. 10 illustrates a modified drinking straw of that in FIG. 9 according to an embodiment.

FIG. 9 illustrates a drinking straw according to another embodiment, and FIG. 10 illustrates a modified drinking straw of that in FIG. 9 according to an embodiment. As illustrated in FIG. 9, a drinking straw 200 is provided. The drinking straw 200 includes an upper end 15, which the user may inhale from to begin drinking. As illustrated in FIGS. 9 and 10, the upper end 15 may include a hole for which the liquid may pass from the drinking straw 200 to the user. The drinking straw 200 may also include a hole 17 located at the bottom of the drinking straw 200. The hole 17 may be covered by a hole cover 16. In one embodiment, the hole cover 16 may be a movable piece that moves to open the hole 17 (e.g., when the user inhales from the drinking straw 200), and moves to close the hole 17 (e.g., when the user stops inhaling from the drinking straw 200). In another embodiment, the rather than having hole 17, the hole cover 16 may extend the entire diameter of the drinking straw 200, and the hole cover 16 may include crack(s) as with the embodiment illustrated in FIG. 4. Further, as illustrated in FIG. 9, the drinking straw 200 may include an exterior cover 18. According to an embodiment, the exterior cover 18 may be attached to the drinking straw 200 from the outside, creating a space between the exterior cover 18 and the drinking straw 200. In another embodiment, the drinking straw 200 may be made without the exterior cover 18.

According to certain embodiments, the cover 18 may have the same functionality in both FIGS. 9 and 10, where only the shape of the cover 18 may change. As illustrated in FIGS. 9 and 10, the cover 18 may be placed around the drinking straw 200, with an empty space between the cover 18 and the drinking straw 200 (e.g., cover 18 may be attached from one or more of its sides to the drinking straw 100). If an amount of liquid pours out of the drinking straw 200, it may go back to the container through the empty space that is between the cover 18 and the drinking straw 200. Further, if the user needs to touch the drinking straw 200, the user may be touching the outer part of the cover 18. As such, the user's hand would not touch the liquid that poured out of the drinking straw 200, or if the drinking straw 200 touches a side of the container, it would not make a mess by the liquid poured out of the drinking straw 200.

As illustrated in FIGS. 9 and 10, with the force of inhaling through the upper end 15 of the drinking straw 200, the hole cover 16 may open slightly upwards. In the meantime, the liquid may enter the hole 17 to pass to the drinking straw 200, and then to the mouth of the user. When the user stops inhaling from the upper end 15 of the drinking straw 200, an amount of the liquid may be kept inside the drinking straw 200. For example, in an embodiment, when the user stops inhaling from the upper end 15 of the drinking straw 200, the cover 16 closes the hole 17, which prevents any liquid from exiting the drinking straw 200. In addition, the weight of the liquid that is above the cover 16 helps to strongly move the cover 16 onto the hole 17, and to cover the hole 17. In the meantime, the liquid may remain inside the drinking straw 200.

According to an embodiment the cover 4 illustrated in FIGS. 9 and 10 may be disposed around the drinking straw 200 so that if the drinking straw 200 shifts or moves around, the liquid within the drinking straw 200 may come out of the drinking straw 200 via the upper end 15. If this should happen, the liquid would go inside the exterior cover 18 and return to the container. In an embodiment, this may keep the drinking straw 200 outer body clean of the liquid, as the user may be (of necessary), holding the exterior cover 18 by the hand. In an alternative embodiment, the drinking straw 200 may be made without the exterior cover 18.

Certain embodiments described herein may provide several improvements, enhancements, and/or advantages. In some embodiments, it may be possible to minimize the air in a drinking straw. In doing so, it may be possible to maintain the external shape of the straw and/or its functionality, while at the same time improve the use experience by reducing airflow with liquid. In other embodiments, may be possible to provide a drinking straw that minimize the air that enters a user's body from using the drinking straw, and improve the health of the user. It may also be possible to provide a drinking straw that is capable of maintaining a certain amount of liquid inside the drinking straw to help maintain and stabilize the drinking straw when it is placed in a container with liquid therein.

Although the foregoing description is directed to the preferred embodiments of the invention, it is noted that other variation and modifications will be apparent to those skilled in the art, and may be made without departing from the spirit or scope of the invention. Moreover, features described in connection with one embodiment of the invention may be used in conjunction with other embodiments, even if not explicitly stated above.

We claim:

1. A drinking straw, comprising:

an outer layer defining an exterior of the drinking straw and an internal space of the drinking straw;

an upper end and a lower end, wherein each of the upper end and the lower end defines a respective opening;

a first cover disposed within the internal space at the lower end covering the opening at the lower end;

a second cover disposed within the internal space at the upper end covering the opening at the upper end; and a single inner wall disposed within the internal space, wherein the outer layer and the inner wall define a first inner compartment and a second inner compartment within the internal space, wherein the first cover is the only cover disposed in the first inner compartment, and the second cover is the only cover disposed in the second inner compartment, wherein a lower edge of the inner wall connects to the first cover and the lower end of the outer layer, and wherein an upper edge of the inner wall connects to the second cover.

2. The drinking straw according to claim 1, wherein the outer layer and the inner wall define the opening at the lower end in the first inner compartment, wherein the outer layer and the inner wall define another opening in the second inner compartment, wherein the first cover covers the opening at the lower end in the first inner compartment, and wherein the second cover covers the another opening in the second inner compartment.

3. The drinking straw according to claim 1, wherein the first inner compartment comprises a first pair of edge pieces, and wherein the first cover is attached to an edge piece of the first pair of edge pieces.

4. The drinking straw according to claim 1, wherein the second inner compartment comprises a second pair of edge pieces, and wherein the second cover is attached to an edge piece of the second pair of edge pieces.

5. The drinking straw according to claim 1, wherein the drinking straw is made of plastic, paper, metal, or a combination thereof.

6. The drinking straw according to claim 2, wherein the first cover is comprised of a first piece and a second piece, wherein the second cover is comprised of a third piece and a fourth piece, wherein the first piece and the second piece cover the lower opening of the first inner compartment, and wherein the third piece and the fourth piece cover the another opening of the second inner compartment.

7. The drinking straw according to claim 1, further comprising an exterior cover that is attached to the drinking straw from the outside.

8. The drinking straw according to claim 2, wherein the first cover and the second cover are located opposite of each other in a lengthwise direction of the drinking straw.

* * * * *